United States Patent [19]

Falcoff

[11] Patent Number: 4,494,677

[45] Date of Patent: Jan. 22, 1985

[54] APPARATUS FOR DELIVERING ACCURATE VOLUME OF LIQUID

[75] Inventor: Allan F. Falcoff, Lake Orion, Mich.

[73] Assignee: E.I. Du Pont De Nemours and Company, Wilmington, Del.

[21] Appl. No.: 444,085

[22] Filed: Nov. 24, 1982

[51] Int. Cl.[3] ..... B67D 5/14

[52] U.S. Cl. ..... 222/63; 73/864.16

[58] Field of Search ..... 222/52, 63, 76, 134, 222/135, 1; 73/864.16

[56] References Cited

U.S. PATENT DOCUMENTS

| | | | |
|---|---|---|---|
| 3,341,076 | 9/1967 | Wasilewski et al. | 222/76 |
| 3,491,919 | 1/1970 | Ramsay | 222/309 |
| 3,615,240 | 10/1971 | Allibert | 137/454.2 |
| 3,756,292 | 9/1973 | Croslin et al. | 141/160 |
| 3,809,296 | 5/1974 | Croslin | 222/309 |
| 3,834,586 | 8/1974 | Wilhelmson | 222/47 |
| 3,912,127 | 10/1975 | Georgi | 222/309 |
| 4,006,847 | 2/1977 | Dooley | 222/263 |
| 4,008,829 | 2/1977 | Chandra et al. | 222/63 |
| 4,026,439 | 5/1977 | Cocks | 222/49 |
| 4,159,784 | 7/1979 | d'Autry | 222/32 |
| 4,159,785 | 7/1979 | Berry, Jr. | 222/63 |
| 4,189,065 | 2/1980 | Herold | 222/46 |
| 4,293,010 | 10/1981 | Winiasz | 141/392 |
| 4,346,742 | 8/1982 | Chase et al. | 73/864.16 |

OTHER PUBLICATIONS

Article—Paint Manufacturing and Resin News, Sep. 1980 pp. 30 and 31.

*Primary Examiner*—Stanley H. Tollberg
*Attorney, Agent, or Firm*—Hilmar L. Fricke

[57] ABSTRACT

An apparatus for delivering an accurate volume of fluid from supply vessel to a mixing vessel in which a piston pump or gear pump is driven by a motor controlled by a motor controller amplifier coupled to a computer which allows the pump to be driven an exact number of strokes or revolutions to move the desired amount of liquid from the supply vessel to a mixing vessel. The apparatus is particularly useful in mixing paints wherein accurate amounts of mill bases are required to be added to achieve a desired paint color.

6 Claims, 3 Drawing Figures

APPARATUS FOR DELIVERING ACCURATE VOLUME OF LIQUID

BACKGROUND OF THE INVENTION

This invention is related to an apparatus that is capable of delivering an accurate volume of liquid.

In custom making of paints, an unpigmented resin solution or dispersion is blended with one or more mill bases which contain dispersed pigments, a liquid carrier and a dispersing resin. To achieve a color match of the paint being made to a standard color, accurate amounts of mill bases must be added and often in very small amounts such as 0.5 cc of a mill base such as black mill base. The slightest deviation from the formula results in an off color paint. Therefore, very accurate delivery equipment is required. A typical prior art apparatus which is used for the precision pumping of fluids is shown in Cocks U.S. Pat. No. 4,026,439 issued May 31, 1977 but this apparatus is not accurate since it uses a pneumatic contol system that does not control the pump accurately, liquid activated check valves that do not accurately control flow and an encoder system having relatively large steps that does not allow for the measurement of very small amounts of fluids.

There is a need for an apparatus for making paints that will accurately and consistently meter out exact volumes of fluid.

SUMMARY OF THE INVENTION

An apparatus for delivering an accurate volume of fluid from a supply vessel to a mixing vessel having the following components:

- a piston pump that has a movable piston with a shaft attached thereto;
- a multiposition valve means that are tubularly connected to the piston pump and to the supply vessel and mixing vessel which in the first position allows fluid to flow from the supply vessel into the pump and in the second position allows fluid to flow from the pump into the mixing vessel;
- a rotatable screw assembly that is mechanically coupled to the shaft of the piston which drives the piston;
- a motor with a shaft coupled to the rotatable screw assembly which drives the screw assembly;
- a tachometer connected to the motor for measuring motor speed;
- a resolver connected to the motor shaft for measuring angular shaft rotation;
- a motor controller amplifier means that is electrically connected to the tachometer and resolver and receives a signal from the tachometer on motor speed and a signal from the resolver on shaft rotation;
- a computer capable of storing programs that is electrically connected to the motor controller amplifier means and to the valve means;

wherein the computer (1) positions the valve means in the first position and through the motor controller amplifier means actuates the motor which drives the screw assembly by a predetermined number of rotations which are directly related to the volume of fluid to be withdrawn from the supply vessel to the pump and moves the piston which withdraws the volume of fluid and (2) positions the valve means in the second position and through the motor controller amplifier means activates the motor which drives the screw assembly by a predetermined number of rotations directly related to the volume of fluid to be charged into the mixing vessel and moves the piston which pumps the volume of fluid into the mixing vessel.

BRIEF DESCRIPTION OF THE DRAWINGS

FIG. 3 shows a solenoid valve assembly that can be used with the apparatus of this invention.

DETAILED DESCRIPTION OF THE INVENTION

The apparatus of this invention is useful for delivering an accurate quantity of fluid from a supply vessel to a second vessel which usually is a mixing vessel. The relative precision of the amount of fluid delivered is the same for very small volumes of fluid such as a 0.5 cc to relatively large volumes such as 25 liters. The apparatus is useful for mixing chemical components and is particularly useful for mixing paints wherein the delivery of a very small volume of a mill base is required to achieve a desired shade along with a large volume of a mill base and a film forming polymer solution or dispersion.

The apparatus is particularly useful in a paint mixing machine wherein a multiplicity of the apparatuses are used. Each apparatus is attached to a separate supply vessel containing a mill base of a different color and at least one apparatus is attached to a film forming polymer solution or dispersion. The mill base may contain the film forming polymer and under such circumstances a separate supply of film forming polymer solution or dispersion is not used. Each apparatus feeds into the same mixing vessel and each is controlled by the same computer. A paint formula is fed into the computer which actuates an appropriate apparatus which dispenses a given volume mill base or polymer solution or dispersion into the mixing vessel. The computer continues to actuate the apparatus that is attached to each of the various mill bases as required by the paint formula until all have been dispensed into the mixing vessel and a paint of a color provided by the formula has been prepared.

In a preferred embodiment of this invention, to insure that an accurate color match of the paint being formulated to a standard paint color is obtained, the paint after it has been mixed is viewed in a cell arrangement by a spectrophotometer or colorimeter. One typical cell that can be used is shown in McKinney et al. U.S. Pat. No. 3,020,795 issued Feb. 13, 1962. If the paint does match the color of the standard paint small amounts of mill bases are then added to achieve the color match.

Figure 1:
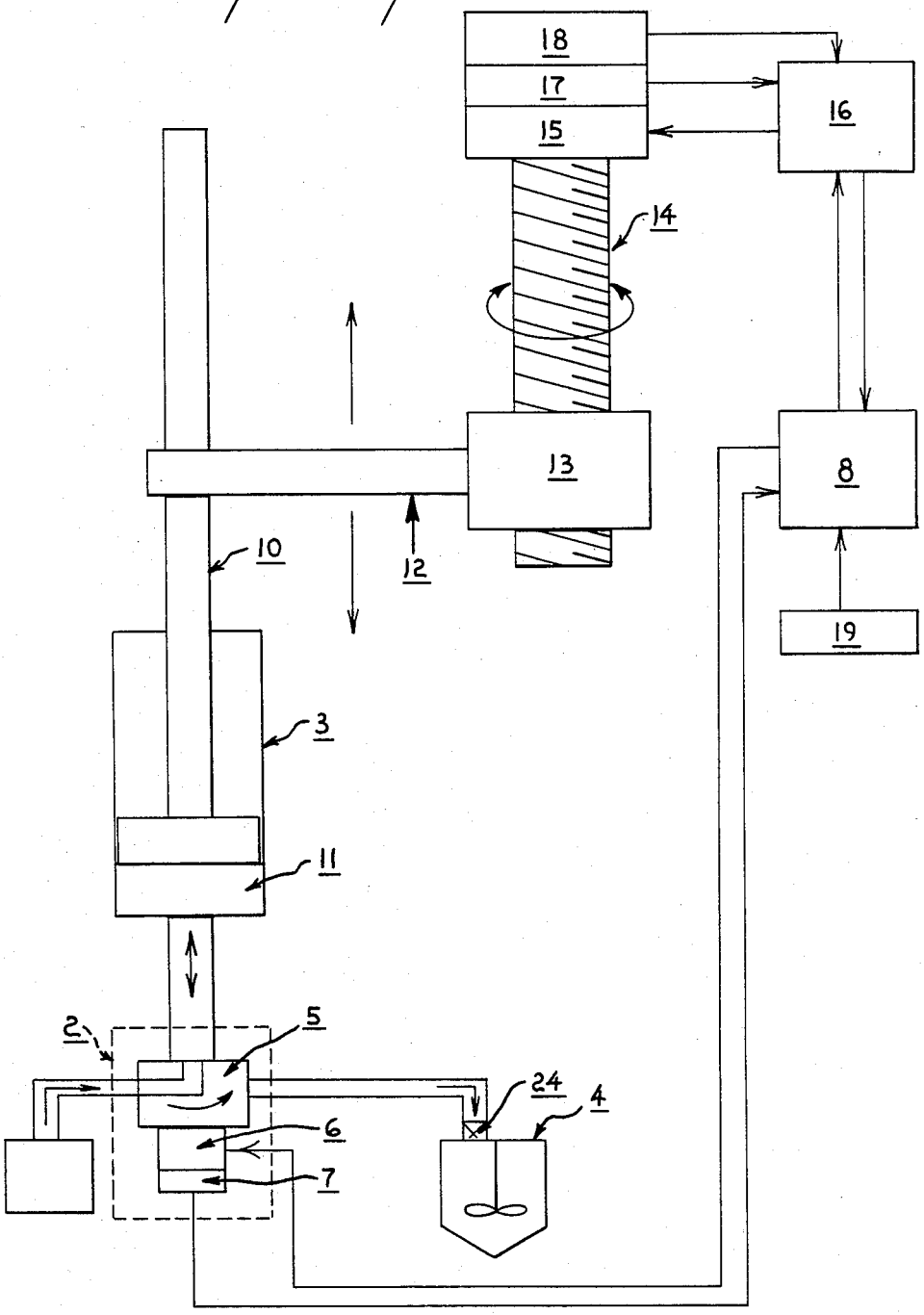
FIG. 1 is a schematic representation illustrating the major components of the apparatus of this invention.

FIG. 1 illustrates the apparatus in which an accurate volume of fluid is pumped from a supply vessel 1, through a multiposition valve means 2 into a piston pump 3 and back through the valve means 2 and valve 24 into a mixing vessel 4 equipped with a stirrer.

Figure 2:
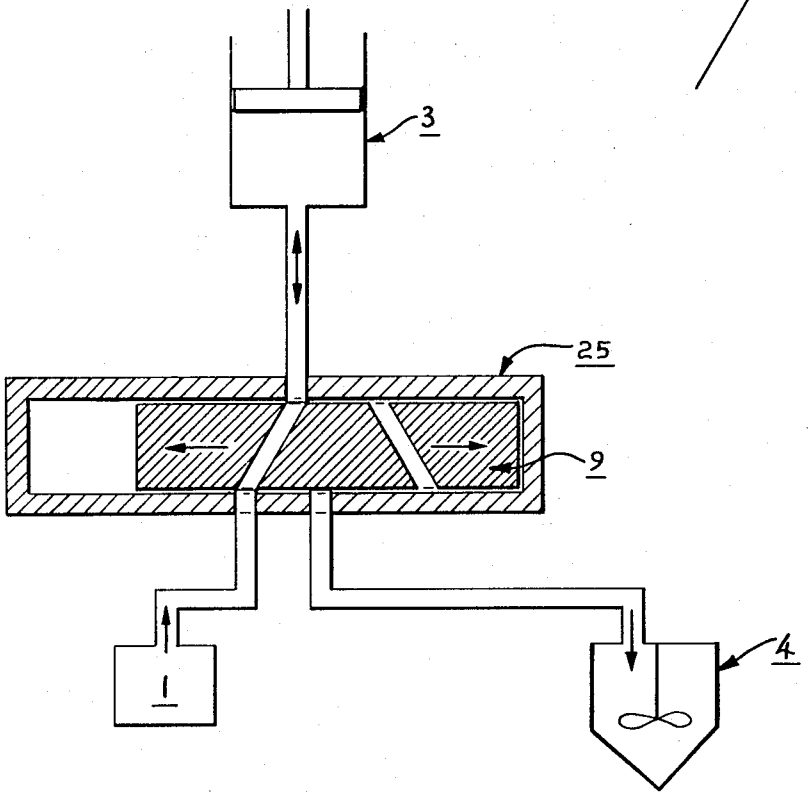
FIG. 2 shows a schematic representation of a shuttle valve that can be used in the apparatus of this invention.
Figure 10:
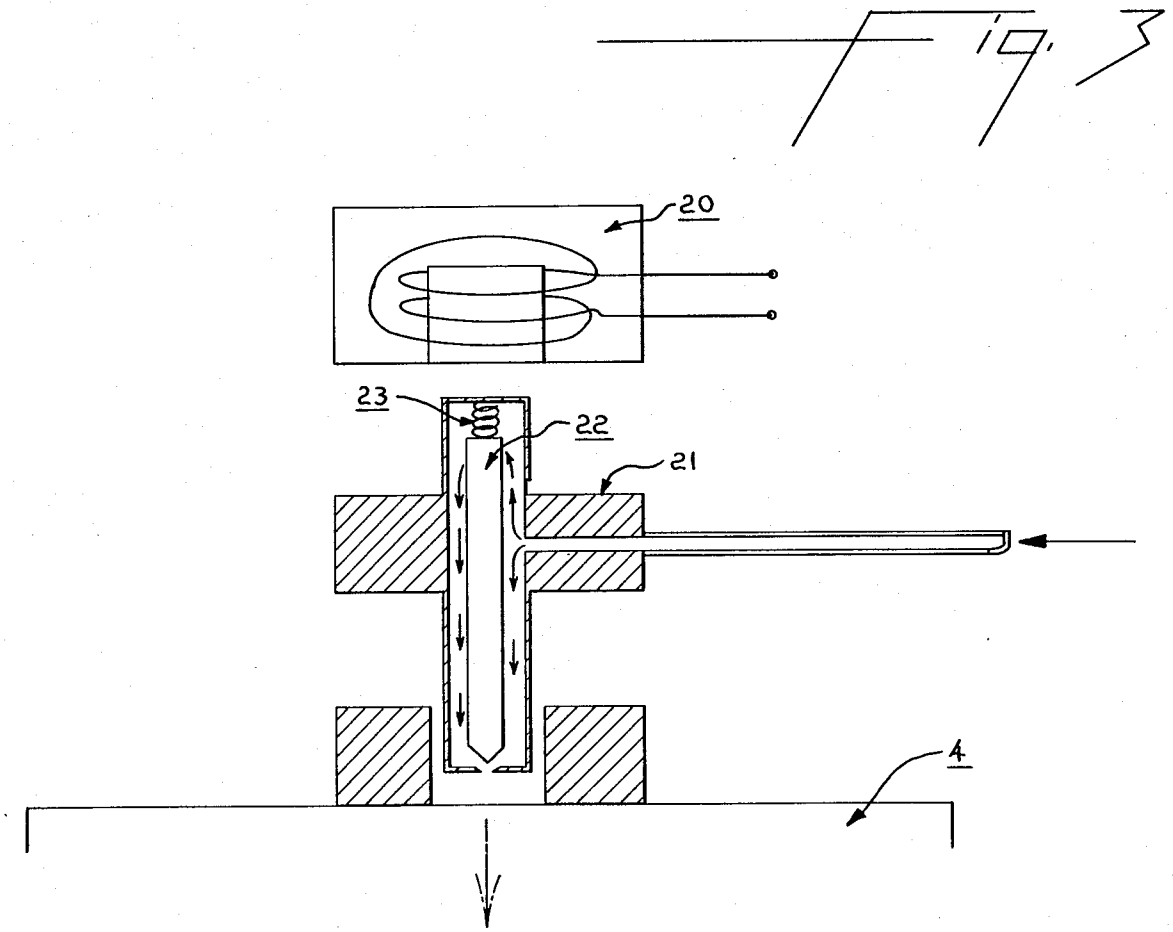

The multiposition valve means 2, shown within the broken lines, contains a valve 5 which in one position allows fluid to flow from the supply vessel 1 into the pump 3 and in the second position allows fluid to flow from the pump 3 into the mixing vessel 4. The valve 5 can be a 3 way ball type valve or a shuttle valve as shown in FIG. 2 which will be described hereinafter. The valve 5 is actuated by a motor 6 which is connected to a computer 8 which controls the motor. The arrow shows the rotation of the valve. The motor 6 can be electrical or a compressed air driven motor. A valve position sensor 7 is coupled to the valve 5 which feeds information on the position of the valve 5 to the computer 8. One preferred valve means 2 which contains a three way ball valve, a compressed air driven motor and a valve position sensor is a Whitey SS-45 X S8-153DA-LSK-153 manufactured by Whitey Corporation.

FIG. 2 illustrates a shuttle valve that can be used in the valve means. The shuttle valve 25 contains a movable shuttle 9 which slides from a first position which allows fluid to flow from the supply vessel 1 to the piston pump 3. In the second position when the shuttle 9 is moved to the left, fluid flows from the pump 3 into the mixing vessel 4. The shuttle 9 is actuated by pneumatic pistons (not shown) which are connected to the computer. A position sensor (not shown) is attached to the shuttle and feeds the position of the shuttle to the computer 8 as discussed above. One advantage of the shuttle valve is that the valve can be immersed in the fluid of the supply vessel which can reduce potential flashing of solvents in the fluid caused by suction of the pump when fluids are withdrawn. Solvent flashing substantially decreases the accuracy of the amount of fluid being withdrawn. If long lines for the fluids are used or if high viscosity fluids are used, the use of a shuttle valve is particularly advantageous.

Referring back to FIG. 1, the shaft 10 attached to the piston 11 of the piston pump 3 is connected to a transverse cross member 12 which in turn is attached to a zero backlash traveller nut 13 which moves up and down on a rotatable screw 14. The screw 14 preferably is a ball screw which has the advantage of high efficiency. Generally, the screw 14 moves the traveller nut 13 about 0.5 inches per rotation. By varying the pitch of the threads of the screw 14, other rates of travel can be readily achieved. The arrows show the direction of travel of the piston and the rotatable screw.

The rotatable screw 14 is driven by a servomotor 15, typically, an Inland Motor, Kollmorgen Corp. Model No. TT2952C. The motor is electrically attached to and controlled by a motor controller amplifier means 16, typically, an Industrial Indexing Systems P.S.C. 100, Inland Motor, Kollmorgen Corp. SP/3-11522-2950-C amplifier, which is electrically coupled to the computer 8. A tachometer 17 is attached to the motor 15 and measures the speed and acceleration of the motor and feeds this information to the motor controller amplifier 16. A resolver 18 connected to the motor measures the angular shaft rotation of the motor and feeds this information to the motor controller amplifier 16. The motor controller amplifier 16 feeds the information from the tachometer 17 and resolver 18 to the computer 8. The computer 8 based on its programmed information determines the number of rotations the screw assembly 14 is required to turn to pump a required amount of fluid from the supply vessel 1 into the mixing vessel 2 and determines the speed and acceleration rate of the motor 15 and feeds this information to the motor controller amplifier 16 which controls the motor 15 and drives the motor at the appropriate speed, acceration and number of rotations. When the motor controller 16 senses the motor 15 has completed its cycle, an operation complete signal is sent to the computer 8.

The computer 8 typically a digital computer such as Intel SBC 80/10B has an input 19 into which formulation information is fed. The input can be a standard key board or a magnetic card input or another computer.

Another aspect of this invention is to use a gear pump such as a Zenith gear pump Model BLB-5456-20 made by Zenith-Nichols Company in place of the piston pump 3. Other gear pumps can also be used. The gear pump is directly attached to and driven by the motor 15 throuh a gear reducer such as a Zenith part No. 72-14615 made by the Graham Company thereby eliminating the screw assembly 14, traveller nut 13 and the traverse cross member 12. Also, the valve means 2 can be eliminated since the gear pump, pumps liquid from the supply vessel 1 directly into the mixing vessel 4. The gear pump is designed to pump an accurate volume of fluid per revolution of the gear pump from the supply vessel 1 into the mixing vessel 4. The computer 8 is programmed with this information and through the motor controller amplifier 16 drives the gear pump the required revolutions to pump the desired amount of liquid into the mixing vessel.

A valve 24, usually a small orifice discharge solenoid valve, is positioned at the end of the tube connecting the valve 5 to the mixing vessel 4. Typically, this valve is a solenoid valve Mode 300827 manufactured by Spraymation Inc. The small orifice of the valve increases the exit velocity of the constituents, i.e., mill base or polymer solution or dispersion, being pumped into the mixing vessel 4 and eliminates retention of the constituent in or on the valve and forces the constituent into the vessel. The solenoid valve 24 is coupled to the computer 8 which opens the valve when fluid is being pumped into the mixing vessel 4 and immediately closes the valve when pumping stops to prevent leakage of fluid to the mixing vessel 4.

A particularly useful solenoid valve assembly is shown in FIG. 3. The solenoid 20 is electrically connected to a power source, not shown, which is controlled by the computer 8. The solenoid 20 is readily disconnected from the valve body 21 which contains the valve stem 22 which is forced open and allows fluid to flow into the mixing vessel 4 when the solenoid 20 is electrically engaged and is held closed by spring 23 when power is off which stops the flow of fluid. One advantage of this assembly is that the valve body can be readily removed and replaced by another valve body, for example, which is attached to another fluid source. This eliminates a multiplicity of solenoids which would be required with a conventional valve where the solenoid cannot be separated from the body.

When the apparatus is used in a typical paint mixing operation, all electrical equipment, such as motors, motor controller, solenoid valves and the like are modified to meet the specifications of Article 500 of The National Electrical Code for operation witin classified environments.

I Claim:

1. An apparatus for delivering an accurate volume of fluid from a supply vessel to a mixing vessel which comprises:

a gear pump capable of pumping an accurate volume of fluid from the supply vessel into the mixing vessel;

a servo motor with a shaft coupled to the gear pump which drives the pump;

a tachometer connected to the motor for measuring motor speed;

a resolver connected to the motor shaft for measuring angular shaft rotation;

a motor controller amplifier means electrically connected to the tachometer and resolver and receives a signal from the tachometer on motor speed and a signal from the resolver on shaft rotation and thereby controls the motor and output of the gear pump;

a computer capable of storing programs electrically connected to the motor controller amplifier means;

wherein the computer through the motor controller means activates the motor which drives the gear pump a predetermined number of rotations directly related to the volume of fluid to be charged into the mixing vessel and pumps the volume of fluid from the supply vessel to the mixing vessel.

2. The apparatus of claim 1 in which the computer is a digital computer.

3. The apparatus of claim 1 in which the computer has a keyboard input or a magnetic card input or has input from a second computer.

4. The apparatus of claim 1 in which a solenoid valve controlled by the computer is positioned between the gear pump and the mixing vessel and opens when liquid is pumped to the mixing vessel and closes immediately thereafter.

5. The apparatus of claim 4 in which the solenoid valve has a solenoid which is removable from the valve.

6. A paint mixing machine comprising a multiplicity of apparatuses wherein each apparatus is attached to a supply vessel containing a mill base or optionally a polymer solution or dispersion and each apparatus feeds into a single mixing vessel; wherein the apparatus comprises:

a gear pump capable of pumping an accurate volume of fluid from the supply vessel into the mixing vessel;

a servo motor with a shaft coupled to the gear pump which drives the pump;

a tachometer connected to the motor for measuring motor speed;

a resolver connected to the motor shaft for measuring angular shaft rotation;

a motor controller amplifier means electrically connected to the tachometer and resolver and receives a signal from the tachometer on motor speed and a signal from the resolver on shaft rotation and thereby controls the motor and output of the gear pump;

a computer capable of storing programs electrically connected to the motor controller amplifier means;

wherein the computer through the motor controller amplifier means activates the motor which drives the gear pump a predetermined number of rotations directly related to the volume of fluid to be charged into the mixing vessel and pumps the volume of fluid from the supply vessel to the mixing vessel; said computer controlling each apparatus thereby allowing each apparatus to pump a predetermined volume of fluid into the mixing vessel to formulate a paint of a desired color.

* * * * *